United States Patent [19]

Kolaska et al.

[11] Patent Number: 4,944,800

[45] Date of Patent: Jul. 31, 1990

[54] PROCESS FOR PRODUCING A SINTERED HARD METAL BODY AND SINTERED HARD METAL BODY PRODUCED THEREBY

[75] Inventors: Hans Kolaska, Bottrop, Fed. Rep. of Germany; Peter Ettmayer, Vienna, Austria

[73] Assignee: Krupp Widia GmbH, Essen, Fed. Rep. of Germany

[21] Appl. No.: 318,177

[22] Filed: Mar. 2, 1989

[30] Foreign Application Priority Data

Mar. 2, 1988 [DE] Fed. Rep. of Germany ..... 3806602

[51] Int. Cl.[5] ..... C22C 29/04

[52] U.S. Cl. ..... 75/238; 75/236; 75/242; 75/242; 75/244; 419/13; 419/15; 419/14; 419/16; 419/17; 419/18; 419/23; 419/33; 419/38; 419/46; 419/53

[58] Field of Search ..... 75/238, 236, 241, 244, 75/242, 246; 419/13, 23, 14, 17, 18, 33, 38, 46, 53, 16, 15

[56] References Cited

U.S. PATENT DOCUMENTS

| | | | |
|---|---|---|---|
| 2,967,349 | 1/1961 | Humenik, Jr. et al. . | |
| 3,507,682 | 4/1970 | Swoboda et al. | 75/236 |
| 3,840,367 | 1/1974 | Rudy | 75/203 |
| 3,971,656 | 7/1976 | Rudy | 75/203 |
| 3,994,692 | 11/1976 | Rudy | 29/182.5 |
| 4,049,876 | 9/1977 | Yamamoto et al. | 428/932 |
| 4,347,083 | 8/1982 | Sara | 75/237 |
| 4,402,744 | 9/1983 | Sara | 75/239 |
| 4,417,922 | 11/1983 | Hall et al. | 75/236 |
| 4,451,292 | 5/1984 | Hall et al. | 75/238 |
| 4,514,224 | 4/1985 | Nishigaki | 75/238 |

OTHER PUBLICATIONS

Sridharam, S., et al., "Investigations Within . . . ", *Monatshefte fur Chemie* (Chemistry Monthly), pp. 127–135 (1983).

Nowotny, H., "Kristallchemie von . . . ", *Angew. Chem.* (Applied Chemistry) vol. 84, No. 20, pp. 973–982 (1972).

Nowotny, H., et al., "Crystal Structures . . . ", *J. Inst. Metals*, vol. 97, pp. 180–186 (1969).

Nowotny, H., et al., "Phase Stability and Crystal Chemistry . . . ", *Phase Stability in Metals and Alloys*, Rudman, P., et al. (Eds.)., McGraw-Hill, New York (1967), pp. 319–336.

*Primary Examiner*—Stephen J. Lechert, Jr.
*Assistant Examiner*—Nina Bhat
*Attorney, Agent, or Firm*—Spencer & Frank

[57] ABSTRACT

A sintered hard metal body having improved heat resistance and higher cutting performance is produced by a process including mixing together at least one hard substance, at least one binder material, and at least one of at least one complex carbide and at least one complex nitride to form a starting mixture each constituent of which is in powdered form. The at least one hard substance is selected from the group consisting of carbides, nitrides, and carbonitrides of transition metals of Groups IVB, VB and VIB of the Periodic Table of Elements, is present as at least one of a carbide, a mixed carbide, a nitride, a mixed nitride, a carbonitride, and a mixed carbonitride, and has a cubic crystal form. The at least one binder metal is selected from the group including iron, nickel and cobalt. The starting mixture is then ground and compressed into a predetermined shape, followed by sintering to melt the at least one binder metal and decompose the complex carbide and/or complex nitride to form at least one of at least one transition metal carbide and at least one transition metal nitride which grows on the surface of the at least one hard substance in powdered form and forms a diffusion inhibiting layer thereon.

24 Claims, 2 Drawing Sheets

PROCESS FOR PRODUCING A SINTERED HARD METAL BODY AND SINTERED HARD METAL BODY PRODUCED THEREBY

CROSS REFERENCE TO RELATED APPLICATION

This Application claims the priority of patent application Ser. No. P 38 06 602.5 filed Mar. 2nd, 1988, in the Federal Republic of Germany, the subject matter of which is incorporated herein by reference.

BACKGROUND OF THE INVENTION

1. Field of the Invention:

The present invention relates to a process for producing a sintered hard metal body and, in particular, to a sintered hard metal body composed of at least one hard substance from the group including carbides, nitrides and/or carbonitrides of the transition metals of Groups IVB, VB and/or VIB of the Periodic Table of Elements and at least one binder metal from the group including iron, nickel and cobalt, with the at least one hard substance being present as a carbide and/or mixed carbide, and/or a carbonitride and/or mixed carbonitride, and/or a nitride and/or mixed nitride in the form of cubic crystals, in which the powdered starting materials are subjected to mixing, grinding, compressing, and subsequently to sintering. The invention also relates to a sintered hard metal body produced by the process according to the invention.

2. Description of the Related Art:

Processes and compositions for producing sintered hard metal bodies are disclosed, in principle, for example, in Kieffer-Benesovsky, *Hartmetall* [Hard Metal], Springer-Verlag Pub. (1965), and in *Hartmetall fur den Praktiker. Aufbau. Herstellung, Eiqenschaften und industrielle Anwendung einer modernen Werkstoffgruppe* [Hard Metals for Practical Structure, Manufacture, Characteristics and Industrial Uses For a Modern Group of Materials], VDI-Verlag GmbH Pub. (1988). In particular, it is known that the useful content of binder metal lies between 3 and 30 weight percent.

Sintered hard metals are known which are based on the hard substances titanium carbide, as described in U.S. Pat. No. 2,967,349, and titanium carbonitride, as described in AT-PS 299,561 and U.S. Pat. No. 3,994,692, bound by means of a nickel-molybdenum binder. These are distinguished by better wear resistance compared to conventional hard metals containing tungsten carbide, as one hard substance phase, cubic titanium mixed carbides, in which part of the titanium atoms are substituted by tantalum, niobium, or tungsten as the second hard substance phase, and cobalt as the binder metal. Titanium carbide and titanium carbonitride hard metals, however, find only limited use as cutting tools, particularly when high cutting speeds are involved and cyclic thermal stresses occur such as during milling. The high temperatures generated at the cutting edges cause the binder metal to lose its strength so that it tends to be plastically deformed under the influence of cutting forces. The noticeably lower thermal conductivity of these TiC—Mo,Ni and Ti(C,N)—Mo,Ni hard metals compared to tungsten carbide undesirably result in accumulation of heat precisely at the point where there is the greatest stress.

To overcome this drawback of TiC—Mo,Ni and the Ti(C,N)-Mo,Ni hard metals, which are superior with respect to wear resistance, it has already been proposed to sinter carbonitride hard substance compositions which include tungsten carbide and an alloyed nickel binder or an alloyed cobalt binder (U.S. Pat. No. 3,840,367 and Federal Republic of Germany Published Application No. 2,546,623, which corresponds to U.S. Pat. No. 4,049,876). However, Ti(C,N) reacts readily with tungsten carbide so that sintering of the hard substance composition must take place under a nitrogen partial pressure which is dependent on the composition and the sintering temperature employed. This, however, undesirably produces microporosity in the structure and causes a reduction in the quality of the hard metal.

U.S. Pat. No. 3,971,656 discloses a hard metal in which the hard substance particles are composed of two phases. The interior of each hard substance particle is composed of a titanium- and nitrogen-rich carbonitride mixed phase and the exterior of each particle is composed of a second phase which is rich in the metals of Group VIB of the Periodic Table of Elements and poor in nitrogen, and which envelops the carbonitride mixed phase comprising the particle's core. Compared to titanium carbide, it is known that titanium nitride increases the resistance to crater formation of hard metals employed as cutting tools for chip cutting work. According to the teaching of U.S. Pat. No. 3,971,656, it is presumed that an equilibrium is established within the hard substance particle composed of two phases. The core of the hard substance particle is thus composed of a carbonitride which is relatively rich in carbon since titanium nitride which is not alloyed is not able to be in equilibrium with the required second phase, which is, for example, a (Mo,W)-rich phase. Thus, the wear resistance of the hard metal, produced according to U.S. Pat. No. 3,971,656 has been determined to be less than optimum.

Another possibility for producing sintered hard metals having improved high temperature resistance is to increase the heat resistance of the binder metal. For example, in addition to including molybdenum in the binder metal, which nickel is able to harden by way of mixed crystal strengthening, aluminum has been additionally alloyed to the binder metal to simulate $\gamma'$ hardening (hardening due to precipitation of coherent particles having a face centered cubic structure) which is known to characterize superalloys of the binder phase. Electron microscopic examination of aluminum-alloyed binder phases within Ti(C,N)—Mo,Ni hard metals proved the occurrence of $\gamma'$ phases. The addition of aluminum resulted in an increase of hardness measured at room temperature, however, the hardness increase was accompanied by a decrease in bending strength (see, for example, H. Doi and K. Nishigaki: in *Modern Development*, Hausner, H. H., Ed., P/M 10, pages 525–542 and D. Moskowitz and M. Humenik, in *Modern Development*. Hauser, H. H., Ed., P/M 14, page 307, (1980)).

In the process under discussion, the aluminum was added to the hard metal starting mixture in the form of powdered, i.e., very fine grained, Ni—Al alloys having grain sizes in the μm range. Such alloys, however, are extremely difficult and expensive to produce due to the very high plasticity of intermetallic alloys in the Ni—Al system. To realize optimum characteristics for the binder metal, it is therefore also necessary to precisely maintain the prescribed carbon content of the sintered alloy so that the quantity of titanium required for coherent precipitation of the $\gamma'$ phase goes into solution from the hard substance employed. Only if the percentages of the aluminum dissolved in the binder metal and of the titanium are approximately equal, can a noticeable influence on the characteristics of the binder metal be expected. If the titanium content is too high, the $\gamma'$ precipitation becomes metastable. If no titanium is present, the coherence tension becomes too low, thus causing the hardening effect to decrease beginning at medium temperatures.

In order to improve heat resistance, AlN has been added to the binder metal as disclosed in Federal Republic of Germany Patent No. 2,830,010, which corresponds to U.S. Pat. No. 4,514,224. The AlN is reported to remain in the structure as a dispersed phase which improves hardness. Under sintering conditions, however, AlN does not form mixed crystals with TiC or with TiN, rather, it constitutes a nonmetal hard substance which does not have good wetting characteristics and, if in finely dispersed form, is not resistant to humidity so that it decomposes into $Al(OH)_3$ and $NH_3$. This has a very disadvantageous effect particularly during grinding with grinding fluids which are not completely free of water.

SUMMARY OF THE INVENTION

It is an object of the present invention to make possible the production of a sintered hard metal body which exhibits increased wear resistance even at higher temperatures while avoiding the above-described drawbacks of the prior art. In particular, it is an object of the present invention to provide a sintered hard metal body which is usable as a cutting tool or cutting plate and which exhibits a noticeably improved cutting performance primarily during machining of workpiece materials which produce chips, including short and long chips.

These and other objects are accomplished by providing a sintered hard metal body including at least one hard substance and at least one binder metal. The at least one hard substance is selected from the group consisting of carbides, nitrides, and carbonitrides of transition metals of Groups IVB, VB, and VIB of the Periodic Table of Elements and has essentially the same composition and crystal form in the sintered hard metal body as it had prior to sintering. The at least one binder metal is selected from the group consisting of iron, nickel and cobalt. The sintered hard metal body, moreover, is produced by a process including mixing together at least one hard substance, at least one binder material, and at least one of at least one complex carbide and at least one complex nitride to form a starting mixture each constituent of which is in powdered form. The at least one hard substance is selected from the group consisting of carbides, nitrides, and carbonitrides of transition metals of Groups IVB, VB and VIB of the Periodic Table of Elements, is present as at least one of a carbide, a mixed carbide, a nitride, a mixed nitride, a carbonitride, and a mixed carbonitride, and has a cubic crystal form. Both the carbides, nitrides and/or carbonitrides and the mixed carbides, mixed nitrides and/or mixed carbonitrides have the form of cubic mixed crystals. The at least one binder metal is selected from the group consisting of iron, nickel and cobalt. After mixing, the starting mixture is ground and compressed into a predetermined shape. The starting material, after compressing same, is sintered to melt the at least one binder metal and decompose the at least one of at least one complex carbide and at least one complex nitride to form at least one of at least one transition metal carbide and at least one transition metal nitride, which at least one of at least one transition metal carbide and at least one transition metal nitride grows on the surface of the at least one hard substance in powdered form and forms a diffusion inhibiting layer thereon.

The at least one complex carbide and/or at least one complex nitride is preferably present in an amount ranging from a finite amount up to 3 weight percent, with reference to the weight of the starting mixture. Preferably, the at least one complex carbide and/or at least one complex nitride contains aluminum and is a member of one of the H phase family thereof, being selected from the group consisting of $Ti_2AlN$, $Ti_2AlC$, $V_2AlC$, $Nb_2AlC$, $Ta_2AlC$, and $Cr_2AlC$; the chi phase family thereof, being selected from the group consisting of $Nb_3Al_2C$, $Ta_3Al_2C$, $Nb_3AlN$, and $Mo_3Al_2C$; or the kappa phase family thereof, being selected from the group consisting Mo—Ni—Al—C, Mo—Co—Al—C, Mo—Mn—Al—C, W—Mn—Al—C, and W—Fe—Al—C. Preferably the aluminum-containing complex carbide and/or aluminum-containing complex nitride are added in such quantities that the binder metal of the sintered hard metal body has an aluminum content which ranges from a finite amount up to 20 weight percent, most preferably, up to 10 weight percent, especially from 2 up to 8 weight percent.

Preferred complex carbides and/or complex nitrides are selected from the group consisting of $Ti_2AlN$, $Ti_2AlC$, $V_2AlC$, $Nb_2AlC$, $Ta_2AlC$, $Cr_2AlC$, $Nb_3Al_2C$, $Ta_3Al_2C$, $Nb_3AlN$, $Mo_3Al_2C$, $MoCr_2Al_2C$, Mo—Ni—Al—C, Mo—Co—Al—C, Mo—Mn—Al—C, W—Mn—Al—C, W—Fe—Al—C, NbCrN, TaCrN, $V_5Si_3N_{1-x}$, $Mo_5Si_3C_{0.6}$, and Ni—Mo—N. Most preferably, the complex carbides and/or complex nitrides are selected from the group consisting of $Ti_2AlC$, $Ti_2AlN$, $V_2AlC$, $Nb_2AlC$, $Ta_2AlC$, NbCrN, and TaCrN; especially form the group consisting of $Ti_2AlC$, $Ti_2AlN$, $V_2AlC$, and $Ta_2AlC$.

Preferably, aluminum-containing complex carbides and/or aluminum-containing complex nitrides are employed. Also employable are complex carbides and complex nitrides which include substances that produce a similar or identical effect as for the aluminum included therein, i.e., complex mixed carbides and/or complex mixed nitrides. Particularly suitable substances include NbCrN, TaCrN, $V_5Si_3N_{1-x}$, $Mo_5$—$Si_3C_{0.6}$.

The terms "complex carbides" and "complex nitrides" are explained, *inter alia*, in *Angew. Chem.* [Applied Chemistry], Volume 84, No. 20 (1972) pages 973 et seq. These are transition metal complex carbides and transition metal complex nitrides wherein the transition metal is preferably selected from Group IVB, VB, and VIB of the Periodic Table of Elements. Further information about crystal chemistry is given in, for example, Rudman, Peter S., Stringer, John, and Jaffee, Robert I., *Phase Stability in Metals and Alloys*, McGraw-Hill Book Company, New York (1967) pages 319-336, and the *Journal of the Institute of Metals*, Vol. 97 (1969) pages 180-186.

Quite unexpectedly, when at least one complex carbide and/or complex nitride, particularly those from the families of the H, chi or kappa phases, was added to a starting mixture including the hard and wear resistant carbides and/or nitrides of the transition metals and a nickel and/or cobalt and/or iron binder metal, particularly hard and wear resistant alloys formed in a surprising manner upon sintering. These alloys were found to be far superior to conventional hard metals for working materials by cutting and/or milling, particularly for working materials which produce short and/or long chips when subjected to continuous or intermittent cutting.

Aluminum-containing complex carbides or complex nitrides from the H, chi and kappa phase families include, for example, the following compounds:

$Ti_2AlN$, $Ti_2AlC$, $V_2AlC$, $V_2AlN$, $Nb_2AlC$, $Ta_2AlC$, $Ta_2AlC$, $Cr_2AlC$, $Nb_3Al_2C$, $Ta_3Al_2C$, $Nb_3AlN$, $Mo_3Al_2C$, $MoCr_2Al_2C$, Mo—Ni—Al—C, Mo—Co—Al—C, Mo—Mn—Al—C, W—Mn—Al—C, and W—Fe—Al—C.

The aluminum-containing complex carbides and complex nitrides may be produced by reacting the nitride or carbide of aluminum with transition metals, preferably in powdered form, or by reacting the nitrides or carbides of the transition metals with aluminum. The reaction products are then pulverized according to comminution methods customary in the hard metal industry and are processed in a known manner together with the remaining components of the hard metal composition into a sintered hard metal body, useful particularly as a cutting tool or a cutting plate.

In order to obtain optimum characteristics, the relative quantities of the aluminum-containing complex carbide and/or complex nitride and the binder metal are selected, with the assumption that the entire aluminum content of the complex carbide and/or complex nitride remains present in the sintered, i.e., finished, hard metal body so that the binder metal has an aluminum content which does not exceed 20 weight percent and, preferably, does not exceed 10 weight percent. Particularly favorable characteristics are obtained if the aluminum content of the binder metal lies between 2 and 8 weight percent.

In the sintered hard metal body, the minimum aluminum content of the binder metal should preferably lie in an order of magnitude of around 1 weight percent.

The complex carbides and complex nitrides are substantially resistant to grinding aids customarily employed during machinery operations. Chemical attack of the complex carbides and/or complex nitrides, or hydrolysis of these compounds need not be feared.

Sintering temperatures of approximately 1350° to 1550° C. are customarily employed and the complex carbides and nitrides in question decompose in the presence of nickel and/or cobalt to produce monocarbides and/or mixed carbides, and/or mononitrides and/or mixed nitrides, respectively, of the transition metals of Groups IVB, VB, and VIB of the Periodic Table of Elements. The monocarbides and mononitrides generally separate, while aluminum is dissolved in the excess nickel and/or cobalt. The dissolved aluminum strengthens the binder metal by a mixed crystal hardening mechanism and, as soon as a threshold content of aluminum in the binder metal is exceeded, is separated during cooling, possibly as a $\gamma'$ phase, e.g., Nowotny, H., et al., *Montash. Chem.*, 114 (1985) pages 127–135. In complex carbides having chromium, molybdenum and tungsten as their transition metal components, part of the transition metal diffuses into the hard substance particles; another part remains dissolved in the binder metal and strengthens the binder metal by way of mixed crystal hardening.

The monocarbides, mononitrides, mixed carbides and/or mixed nitrides of the transition metals formed during the reaction of the complex carbides and/or nitrides with the liquid binder metal are precipitated epitaxially at the surface of the hard substance particles and have been found to completely envelope the hard substance particles. At sintering temperatures between 1350° C. and 1550° C. and sintering times up to two hours, the rates of diffusion of these materials into the hard substance particles are not sufficient to establish a metallurgical equilibrium between the respective hard substance particle and its envelope of monocarbides, mononitrides, mixed carbides and/or mixed nitrides nitrides of the transition metals. Rather, the monocarbides, mononitrides, etc. of the transition metals form a diffusion inhibiting barrier layer which envelopes the hard substance particles and prevents further substance exchange, e.g., alloying, between the respective hard substance particle and the binder metal constituents. The chemical composition of the core of the enveloped hard substance particle in the sintered hard metal is thus essentially identical to, i.e., is substantially unchanged from, the chemical composition of that hard substance particle in the starting mixture from which the hard metal body was produced by compression and sintering. Even in the sintered hard metal body, the cubic crystals and/or cubic mixed crystals enveloping each hard substance particle remain in their non-equilibrium state. In a metallographic section, this phenomenon becomes evident in that even fine grained hard substance particles exhibit a distinct edge zone. This edge zone is the enveloping phase composed of monocarbides, mononitrides, mixed carbides, and/or mixed nitrides of the transition metals and can be clearly distinguished from the core zone of the hard metal particles with respect to their metal components, generally, transition metals of Group IV and VI of the Periodic Table of Elements, as well as with respect to their non-metal components, for example, carbon and nitrogen.

The sintered hard metal according to the invention combines the favorable characteristics of the carbides of the transition metals in the edge zones enveloping each hard substance particle, which carbides are easily wetted by conventional binder metals, with the high wear resistance of the nitrides in the core zone and, due to the content of titanium and aluminum in the binder metal, exhibits such a high wear resistance that cutting tools and cutting plates produced therefrom yield noticeably improved cutting performances. Another advantage of the sintered hard metal according to the invention is that the monocarbides, mononitrides, etc. formed during the reaction of the complex carbides and nitrides with the liquid binder metal of the transition metals are epitaxially precipitated on the surface of the hard substance particles and thus prevent further changes of the hard substance core under the influence of the liquid binder metal. In this way it is possible, for example, to substantially maintain the nitrogen content of a fine grained titanium nitride in the core of the hard substance particles even during sintering in vacuo, for example, in compositions in which titanium nitride is employed together with $Ti_2AlC$ or $V_2AlC$ and nickel.

The sintered hard metal body that can be produced by the process according to the invention is essentially characterized in that the hard substances contributing to the formation of the starting mixture are present in the sintered hard metal body, i.e., upon completion of the manufacturing process, essentially in their original composition.

The existing hard substance carbides and/or mixed carbides and/or nitrides and/or mixed nitrides which are enveloped in the monocarbide and/or mononitride and/or mixed carbides and/or mixed nitrides diffusion inhibiting layer thus indicate by their structure that establishment of an equilibrium in the metallurgical sense has been prevented between the various hard substances within the hard substance particles. This intentionally produced non-equilibrium state results in the already mentioned improved wear resistance even under extreme operating conditions.

BRIEF DESCRIPTION OF THE DRAWING

The invention will now be described in greater detail for several embodiments thereof and with reference to the drawing figures in which.

DESCRIPTION OF THE PREFERRED EMBODIMENTS

The conventional hard metal (see FIG. 1, left-hand blocks) used for comparison is composed of 57% TiC, 10% TiN, 10% WC, 2% VC, 10% Mo, as well as 5.5% Ni and 5.5% Co. The hard metals according to the invention, including the complex nitride-modified binder metal (see the blocks in the middle and on the right-hand side of FIG. 1), were produced in a known manner from the same basic material as the conventional hard metal with the addition, respectively, of 0.6% and 2.2% $Ti_2AlN$, with simultaneous reduction of the nickel and cobalt content to 5.2% and 4.4%, respectively. In the sintered hard metal, the associated aluminum content in the binder metal is about 2% and somewhat more than 7%, respectively.

Figure 1:
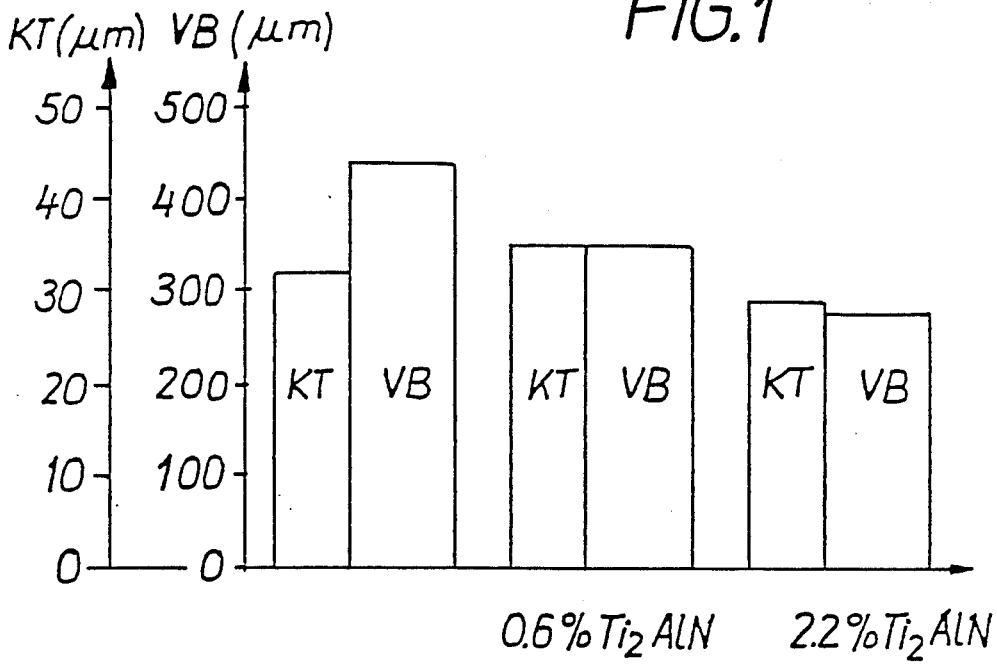
FIG. 1 is a graph comparing values for crater depth (KT in μm) and flank wear (VB in μm) of a cutting plate made of a conventional hard metal or of two hard metals, respectively, to which different amounts of complex nitrides from the H phases family thereof, namely, $Ti_2AlN$, have been added prior to sintering, during the turning of steel Cm45N in a continuous cut.

As shown by FIG. 1, the crater depth, KT, for the hard metals to be compared lies at about 30 to 35 μm for cutting tests made at the workpiece material Cm45N with a cutting speed of 355 m/min, a cutting time of 12.5 minutes, and with the product of cutting depth and feed lying in an order of magnitude of $1.0\times0.1$ $mm^2$/revolution.

The flank wear, VB, for the conventional hard metal (left blocks) is 450 μm and becomes less with increasing $Ti_2AlN$ content in accordance with the invention (see the blocks in the middle and on the right-hand side of FIG. 1). While the crater depth, KT, was not improved by the addition of $Ti_2AlN$, the flank wear, VB, decreases from about 450 to 280 μm with increasing $Ti_2AlN$ content.

Figure 2:
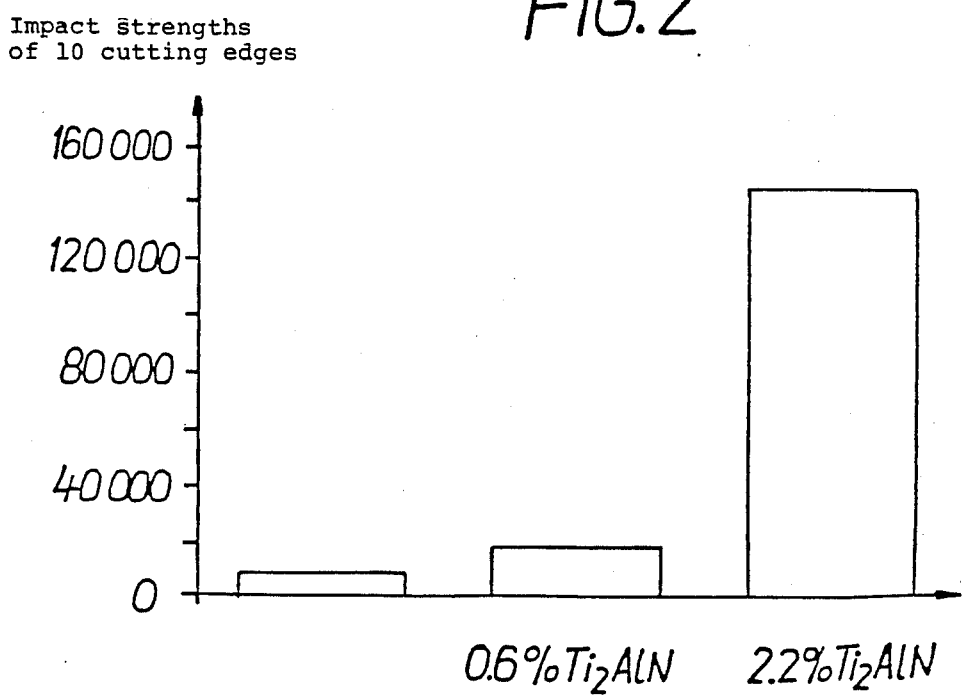
FIG. 2 is a graph comparing impact strength for the hard metals described in connection with FIG. 1 during turning of a CK45N steel by intermittent cutting.

FIG. 2 shows the impact strength of 10 cutting edges for the three above-mentioned hard metals. The cutting test was made for a shaft made of Ck45N material, cutting was performed at a speed of 200 m/min, and the product of cutting depth and feed was $2.5\times0.2$ $mm^2$/revolution.

While the conventional hard metal (left-hand block) attained only an impact strength of about 10,000, the addition of 0.6% $Ti_2AlN$ in accordance with the invention (center block) already resulted in a doubling of the impact strength to 20,000. The hard metal in which 2.2% $Ti_2AlN$ was added to the starting mixture in accordance with the invention (right-hand block) was able to withstand even 160,000 impacts. Thus, during turning with uninterrupted cuts, the hard metals configured according to the invention are clearly superior to the conventional hard metal.

In milling work (see FIG. 3), tools, e.g., cutting plates, made of the hard metals configured according to the present invention (center and right-hand blocks) were able to produce considerably better cutting performances compared to a tool made of the conventional hard metal. The addition of 0.6% and 2.2 % $Ti_2AlN$, respectively, increased the resulting milling path from about 80 mm to about 1200 mm and 1600 mm, respectively.

Figure 3:
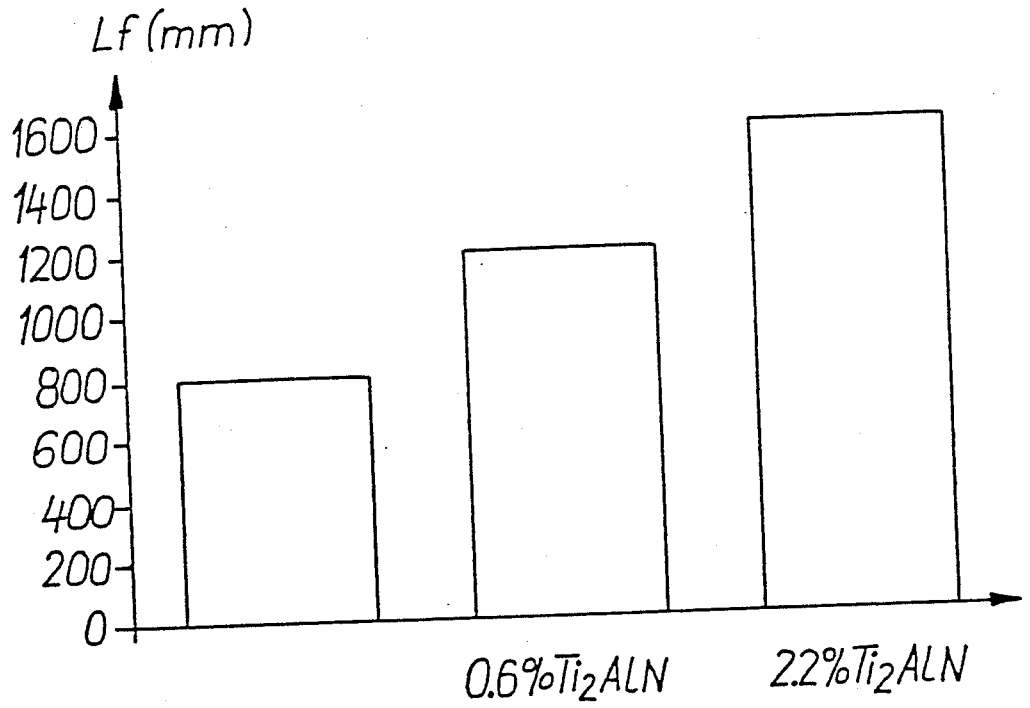
FIG. 3 is a graph comparing milling length (Lf in mm) of the hard metals described in connection with FIG. 1.

Milling tests, the results of which are shown in FIG. 3 in the form of a milling path, LF in mm, were made with a shaft made of refined steel 42CrMo4 at a cutting speed of 250 m/min. The associated product of cutting depth, chip cross section and feed per tooth lies at $1.0\times120\times0.1$ mm/tooth.

With respect to cutting performance, tools, e.g., cutting plates, made of hard metals in which aluminum-containing complex nitrides were added to the starting mixtures in accordance with the present invention are thus, as documented by the test results, far superior to tools, e.g., cutting plates, made of the conventional hard metal, particularly for turning with intermittent cutting and for milling.

The improved wear resistance, which also makes the hard metals according to the invention interesting for other applications, is based on the fact that the starting mixture for the production of the hard metal or hard metal body is combined in such a manner that, at the moment when the binder metal phase begins to melt, certain chemical reactions are initiated very quickly and result in the formation of a diffusion inhibiting layer around the surfaces of the hard substance particles of the starting mixture. The intentional selection of the components forming the starting mixture thus has the result that no metallurgical equilibrium can be established in the finished hard metal or hard metal body. Thus, the respective optimum characteristics of the different hard substance particles, such as the known wear resistance of titanium nitride and the known excellent hardness of titanium carbide, are retained in the finished hard metal. If a metallurgical equilibrium were established, as is customary in the prior art, at least some of the individual characteristics of the hard metal particles according to the invention would be lost.

Thus, in contrast to the prior art, the present invention recognizes the desirability of not establishing a metallurgical equilibrium and provides a process which produces a sintered hard metal body characterized by not having a metallurigical equilibrium established therein.

Table I gives eight examples of compositions for starting powder mixtures according to the invention.

For hard metals composition numbers 1 to 4, except for the complex carbide/complex nitride, the sintered hard metal body is produced exclusively from powders of the pure components, e.g., TiC, TiN, WC, etc. For the production of hard metal composition numbers 5 to 8, powdered pre-alloys were used, e.g., Ti(N,C), (W,Ti,Ta,Nb)C. This variation of the manufacturing process has the advantage that it noticeably improves the quality of the sintered hard metal product compared to production of the sintered hard metal product from the pure components. This is believed to be due to the reduced requirement for chemical reactions between the individual components of the starting powder mixture. All percentages are weight percentages.

It will be understood that the above description of the present invention is susceptible to various modifications, changes and adaptations, and the same are intended to be comprehended within the meaning and range of equivalents of the appended claims.

What is claimed is:

1. A process for producing a sintered hard metal body, comprising:

mixing together at least one hard substance, at least one binder material, and at least one of at least one complex carbide and at least one complex nitride to form a starting mixture each constituent of which is in powdered form, wherein the at least one hard substance is selected from the group consisting of carbides, nitrides, and carbonitrides of transition metals of Groups IVB, VB and VIB of the Periodic Table of Elements, is present as at least one of a carbide, a mixed carbide, a nitride, a mixed nitride, a carbonitride, and a mixed carbonitride, and has a cubic crystal form, and wherein the at least one binder metal is selected from the group consisting of iron, nickel and cobalt;

grinding the starting mixture;

compressing the starting mixture, after grinding same, into a predetermined shape; and sintering the starting material, after compressing same, to melt the at least one binder metal and decompose the at least one of at least one complex carbide and at least one complex nitride to form at least one of at least one transition metal carbide and at least one transition metal nitride, which at least one of at least one transition metal carbide and at least one transition metal nitride grows on the surface of the at least one hard substance in powdered form and forms a diffusion inhibiting layer thereon.

2. The process according to claim 1, wherein the at least one of at least one complex carbide and at least one complex nitride is present in an amount ranging from a finite amount up to 3 weight percent, with reference to the weight of the starting mixture.

3. The process according claim 1, wherein the at least one of at least one complex carbide and at least one complex nitride contains aluminum.

4. The process according to claim 3, wherein the at least one of at least one complex carbide and at least one complex nitride is a member of the H phase family thereof.

5. The process according to claim 4, wherein the at least one of at least one complex carbide and at least one complex nitride is selected from the group consisting of $Ti_2AlN$, $Ti_2AlC$, $V_2AlC$, $Nb_2AlC$, $Ta_2AlC$ and $Cr_2AlC$.

6. The process according to claim 3, wherein the at least one of at least one complex carbide and at least one complex nitride is a member of the chi phase family thereof.

7. The process according to claim 6, wherein the at least one of at least one complex carbide and at least one complex nitride is selected from the group consisting of $Nb_3Al_2C$, $Ta_3Al_2C$, $Nb_3AlN$ and $Mo_3Al_2C$.

8. The process according to claim 3, wherein the at least one of at least one complex carbide and at least one complex nitride is a member of the kappa phase family thereof.

9. The process according to claim 8, wherein the at least one of at least one complex carbide and at least one complex nitride is selected from the group consisting Mo—Ni—Al—C, Mo—Co—Al—C, Mo—Mn—Al—C, W—Mn—Al—C and W—Fe—Al—C.

10. The process according to claim 3, wherein the binder metal of the sintered hard metal body has an aluminum content which ranges from a finite amount up to 20 weight percent.

11. The process according to claim 10 wherein said aluminum content ranges up to 10 weight percent.

12. The process according to claim 11, wherein said aluminum content ranges from 2 up to 8 weight percent.

13. The process according to claim 1, wherein the at least one of at least one complex carbide and at least one complex nitride is selected from the group consisting of $Ti_2AlN$, $Ti_2AlC$, $V_2AlC$, $Nb_2AlC$, $Ta_2AlC$, $Cr_2AlC$, $Nb_3Al_2C$, $Ta_3Al_2C$, $Nb_3AlN$, $Mo_3Al_2C$, $MoCr_2Al_2C$, Mo—Ni—Al—C, Mo—Co—Al—C, Mo—Mn—Al—C, W—Mn—Al—C, W—Fe—Al—C, NbCrN, TaCrN, $V5Si_3N_{1-x}$, $Mo_5Si_3C_{0.6}$, and Ni—Mo—N.

14. The process according to claim 13, wherein the at least one of at least one complex carbide and at least one complex nitride is selected from the group consisting of $Ti_2AlC$, $Ti_2AlN$, $V_2AlC$, $Nb_2AlC$, $Ta_2AlC$, NbCrN, and TaCrN.

15. The process according to claim 13, wherein the at least one of the at least one complex carbide and at least one complex nitride is selected from the group consisting of $Ti_2AlC$, $Ti_2AlN$, $V_2AlC$, $Ta_2AlC$.

16. A sintered hard metal body comprised of at least one hard substance and at least one binder metal, the at least one hard substance being selected form the group consisting of carbides, nitrides, and carbonitrides of transition metals of Groups IVB, VB, and VIB of the Periodic Table of Elements and having essentially the same composition and crystal form in the sintered hard metal body as it had prior to sintering, and the at least one binder metal being selected from the group consisting of iron, nickel and cobalt, the sintered hard metal body being produced by a process comprising:

mixing together at least one hard substance, at least one binder material, and at least one of at least one complex carbide and at least one complex nitride to form a starting mixture each constituent of which is in powdered form, wherein the at least one hard substance is selected from the group consisting of carbides, nitrides, and carbonitrides of transition metals of Groups IVB, VB and VIB of the Periodic Table of Elements, is present as at least one of a carbide, a mixed carbide, a nitride, a mixed nitride, a carbonitride, and a mixed carbonitride, and has a cubic crystal form, and wherein the at least one binder metal is selected from the group consisting of iron, nickel and cobalt;

grinding the starting mixture;

compressing the starting mixture, after grinding same, into a predetermined shape; and sintering the starting material, after compressing same, to melt the at least one binder metal and decompose the at least one of at least one complex carbide and at least one complex nitride to form at least one of at least one transition metal carbide and at least one transition metal nitride, which at least one of at least one transition metal carbide and at least one transition metal nitride grows on the surface of the at least one hard substance in powdered form and forms a diffusion inhibiting layer thereon.

17. The sintered hard metal body according to claim 16, wherein the at least one hard substance is enveloped in a diffusion inhibiting envelope comprising at least one material selected from the group consisting of monocarbides, mixed carbides, mononitrides, and mixed nitrides of transition metals, which at least one material is epitaxially precipitated onto the surface of the at least one hard substance in powdered form during sintering.

18. The sintered hard metal body according to claim 16, wherein the at least one of at least one complex carbide and at least one complex nitride is present in an amount ranging from a finite amount up to 3 weight percent based on the weight of the starting mixture before sintering.

19. The sintered hard metal body according to claim 16, wherein the binder metal has an aluminum content which ranges from a finite amount up to 20 weight percent.

20. The sintered hard metal body according to claim 19, wherein said aluminum content ranges from a finite amount up to 10 weight percent.

21. The sintered hard metal body according to claim 20, wherein said aluminum content ranges from 2 up to 8 weight percent.

22. The sintered hard metal body according to claim 16, wherein the at least one binder metal additionally includes at least one element obtained during sintering from at least one of a complex carbide and a complex nitride containing said at least one element.

23. The sintered hard metal body according to claim 22, wherein said at least one element is selected from the group consisting of Al, Cr, Si and Mo.

24. The sintered hard metal body according to claim 16, wherein the at least one hard substance is comprised, after sintering of a starting mixture in powdered form, of core zones comprising said at least one hard substance, and edge zones comprising an enveloping phase comprised of at least one material selected from the group consisting of monocarbides, mixed carbides, mononitrides, and mixed nitrides of transition metals, precipitated onto each of the core zones during sintering which decomposes at least one of a complex carbide and a complex nitride included in the starting mixture and forms the enveloping phase, which enveloping phase functions as a diffusion inhibiting layer to prevent establishment of a metallurgical equilibrium so that the core zones have essentially the same composition and crystal form in the sintered hard metal body as they had prior to sintering so that an improved wear resistance even at high temperatures is obtained.

* * * * *